United States Patent [19]

Aebli

[11] 4,235,591

[45] Nov. 25, 1980

[54] CONTINUOUS FLOW OVEN

[75] Inventor: Heinrich Aebli, Kreuzlingen, Switzerland

[73] Assignee: Gautschi Electro-Fours SA., Täegerwilen, Switzerland

[21] Appl. No.: 908,244

[22] Filed: May 22, 1978

[30] Foreign Application Priority Data

May 24, 1977 [CH] Switzerland ..... 6416/77

[51] Int. Cl.[3] ..... F27B 9/28

[52] U.S. Cl. ..... 432/8; 432/11; 432/21; 432/59; 432/145; 432/149; 432/152; 432/199

[58] Field of Search ..... 432/8, 11, 21, 59, 145, 432/149, 152, 199

[56] References Cited

U.S. PATENT DOCUMENTS

| | | | |
|---|---|---|---|
| 2,512,326 | 6/1950 | Harrison | 432/21 |
| 2,731,732 | 1/1956 | Harris, Jr. et al. | 432/8 |
| 2,795,054 | 6/1957 | Bowen | 432/8 |
| 3,186,694 | 6/1965 | Beggs | 432/21 |
| 3,874,091 | 4/1975 | Fukumoto | 432/59 |
| 4,116,620 | 9/1978 | Stibbe | 432/59 |

*Primary Examiner*—John J. Camby

*Attorney, Agent, or Firm*—Omri M. Behr; Martin Sachs

[57] ABSTRACT

A continuous flow heating oven of the industrial type used for the heating of ingots, sheet material and the like, which may be of light metal or light metal alloy, includes a burner fired with a liquid or gaseous fuel disposed within a heating chamber. The material to be heated is placed within the oven with the convection air currents generated from the burners directed thereon, with the hot combustion gases produced by the flames. In addition, the exhaust gases are compressed and directed back onto the object to be heated interspersing with the convection air currents originally generated to increase the efficiency of heating the material.

8 Claims, 8 Drawing Figures

CONTINUOUS FLOW OVEN

BACKGROUND OF THE INVENTION

The present invention relates to ovens for continuously heating ingots, sheet material, and the like of light metal or light metal alloy and, in particular, to a relatively high efficiency oven which utilizes the exhaust gases of the heating device to help heat the material more efficiently thereby causing a minimum of environmental contamination.

Prior art ovens used for heating raw material such as ingots or sheet strips utilized a very small portion of the available heat produced by the heating burners to heat material. The exhaust gases frequently leave the oven at relatively high temperatures thereby contaminating the environment and making poor use of the available energy. Wasting the fuel and heat generated thereby increases the cost of the heating process, increases the time required in order to process the material and increases environmental contamination.

For many years inventors have attempted to overcome these disadvantages and have developed processes wherein the thermal efficiency of the oven has been improved by pre-heating the air used in the combustion process with the exhaust gases. However, this approach has not been proved successful. Other approaches include a process wherein the cold fresh air to be utilized in the combustion process is pressurized by a ventilator or fan and warmed by a heat exchanging means which utilizes exhaust gases as a heat source. Additionally included is a turbine system which at the same time increases the speed of the hot exhaust gases, thus bringing about recovery of some heat, which is normally lost in the exhaust gases. The inherent disadvantage with this type of process lies in the fact that large amounts of heat are still lost. It has also been found that this process tends to heat the material at a relatively rapid rate which in itself may be a disadvantage.

It is desirable to provide an industrial heating oven which does not have the shortcomings known in the prior at, does not use abnormal amounts of energy, and can provide even heating of the material by utilizing the exhaust gases more efficiently. Industry today has a need for processes which have increased efficiency and do not contaminate the environment. The present invention overcomes the shortcomings found in the prior art by providing an efficient means for raising the transfer efficiency of objects to be heated without requiring additional fuel or contaminating the environment.

Therefore, it is an object of the present invention to provide a continuous flow oven for heating material such as ingots, sheet material and the like with relatively low environmental contamination.

Another object of the present invention is to provide a means for using the heat generated in the exhaust gases of the heating process to aid in the heating of the material.

The above objects, as well as further objects and advantages of the present invention, will become readily apparent after reading the description of a non-limiting illustrative embodiment and accompanying drawing.

SUMMARY OF THE INVENTION

The oven of the present invention utilizes exhaust jets directed onto the objects to be heated. These jets communicate with the exit side of a power blower. The intake of this blower sucks air from the exit channel of the furnace chamber. Thus, the intake of the blower comprises newly generated exhuast gases and recycles these exhaust gases back into the furnace space. The combined gases are directed by the jets onto the object or materials to be heated. The impact of these gases jetted onto the objects to be heated increases the efficiency of the transfer of the heat content of the exhaust gases and raises the temperature of the objects to be heated, thereby utilizing the thermal content of the exhaust gases more efficiently.

The continuous flow oven for heating materials, according to the principles of the present invention, comprises; a heating chamber having an input opening, exit opening and an exhaust port, the input opening being adapted to receive materials which exit via the exit opening, means for heating the material by convection air current directed thereto, blower means having intake and exhaust openings disposed proximate the chamber exhaust port and within the heating chamber and exhausting them under pressure, a pressure chamber cooperating with the blower exhaust opening and receiving the pressurized air currents, the pressure chamber being provided with a plurality of exhaust jets directed towards the material to be heated, the pressurized air currents mixing and interspersing with the air currents. The air currents are exhaust gases generated by the heating means.

The method of heating continuously moving material according to the principles of the present invention comprises; feeding the material into the input opening of a heating chamber having an exit opening and an exhaust port, heating a material by convection air currents directed thereto, compressing a major portion of the convection air currents appearing proximate the exhaust port, and directing the compressed air currents by means of jets toward the material to be heated to mix and intersperse with the convection air currents.

BRIEF DESCRIPTION OF THE DRAWINGS

In order that the invention may be more fully understood, it will now be described by way of example with reference to the accompanying drawings.

DESCRIPTION OF THE PREFERRED EMBODIMENTS

Figure 1:
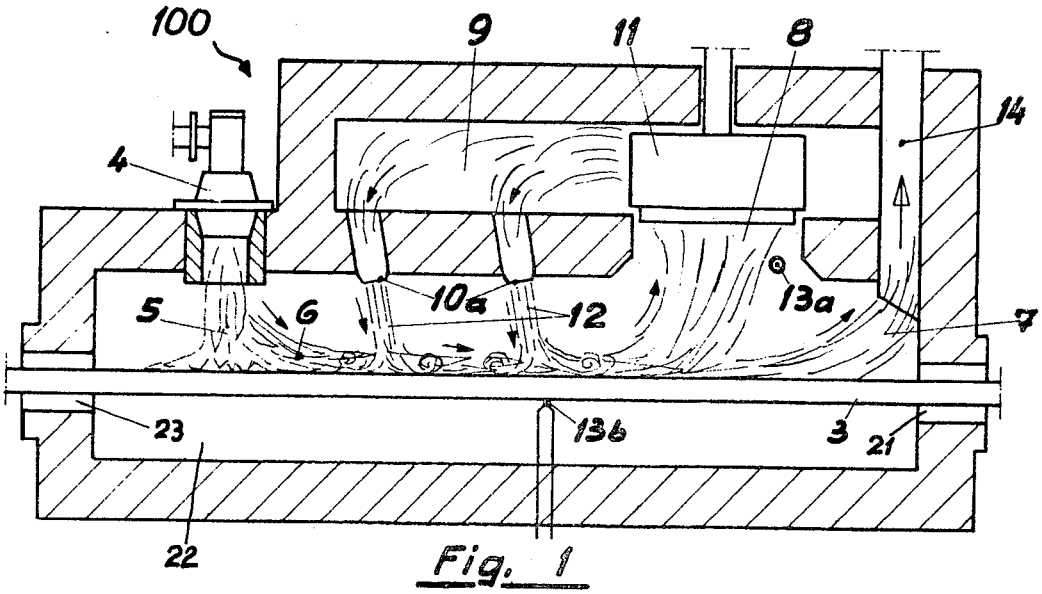
FIG. 1 is a pictorial representation of a longitudinal cross-section in elevation of one embodiment of an oven according to the principles of the present invention, showing a band of sheet material passing through the oven and being heated on one side thereof.

Referring now to the figures and, in particular, to FIG. 1 which shows an oven 100 fabricated in accordance with the principles of the present invention. The oven 100 includes an input opening 23, an output opening 21, and an exhaust port 14. The material to be heated is shown in the form of sheet material 3 which may be, for example, an aluminum strip having, for example, dimensions of 1700 mm long and 22 mm wide. The strip 3 is fed intp the heating chamber 22 through the input opening 23 and exits, after being heated, through the exit opening 21. In the region of the entry opening 23 there is placed an oil or gas burner 4 which, when ignited, generates a flame 5 which is directed to impinge upon the material 3. As a result of flame 5 impinging upon the material 3, the temperature is raised very rapidly because of the combination of the convection air currents and the heat radiation generated by the flame 5. Exhaust gases 6, generated from the burning of the flame, passes along the length of the sheet material 3 toward the flue canal or exhaust port 14 which is located proximate the exit opening 21.

In the vicinity of the exhaust port 14, a portion 8 of the exhaust gases are removed by a hot gas blower or ventilator 11, which has an intake opening 30 facing in the direction of the material to be heated within the oven space 22. The gases 8 are removed by blower 11 and pass therethrough, exiting by the exhaust opening 31 into a compression chamber 9 in which the gases are compressed, and are directed through jets 10*a* at a higher speed in the form of a secondary exhaust or pressurized gas stream 12. The jets may be directed perpendicularly or slightly angled to the strip 3.

These exit gases 12 impinge upon the primary or original exhaust gas stream 6 and by their impact thereon increase the efficiency of the heat transfer of these primary gases by interspersing therewith on the material to be heated. It is believed that the increased efficiency of heating is accomplished by the convection currents of the auxiliary or secondary exhaust gases disrupting the boundary layers formed between the primary exhaust gases 6 and the material to be heated 3.

A portion of the recycled exit gases 6 are mixed with the fresh exhaust gases and are continually extracted by the intake of blower 11 in the manner described hereinbefore, pressurized and again blown onto the object to be heated by jets 10*a*. At the same time a portion 7 of the exhaust gases which have been used up exit through the exhaust port or flue 14 in a conventional manner. The heat content of these exiting gases 7, however, is substantially lower than that of ovens known in the prior art. Thus, material to be heated more fully utilizes the available heat and operates more efficiently than the prior art devices.

Proximate the intake area of blower 11 there is provided a temperature sensing device 13*a* which operates in a conventional manner and controls the heat input of burner 4 so that excessive heating or overheating of the blower 11 is avoided. In addition, a second sensing device 13*b* is provided proximate the material to be heated, and here again it is adapted to control the amount of heat to be generated from the burner 4 so that the material will not be subjected to excessive amounts of heat. The manner of controlling the burner 4 is conventional and therefore not shown at this time.

In the other embodiments of the present invention, which are disclosed in the remaining figures, the last two digits will remain the same for objects performing the same functions and are generally equivalent; however, they will be preceded by a digit corresponding to the figure number referred to.

Figure 2:
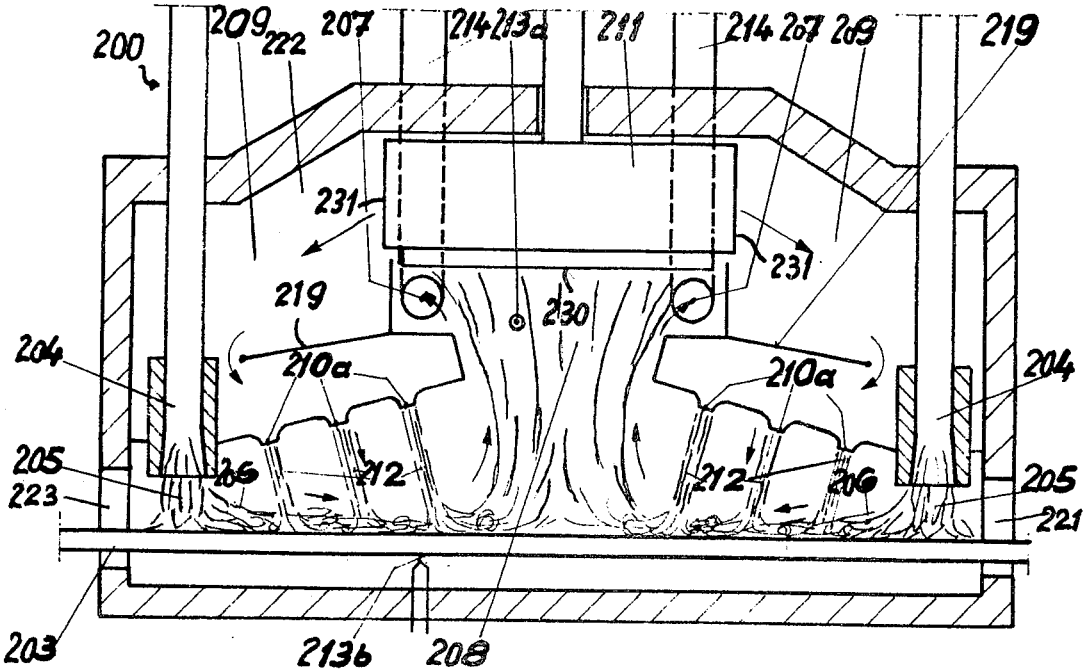
FIG. 2 is a longitudinal cross-section in elevation of a second embodiment of the oven of the present invention showing the heating of one side of the material traversing therethrough.

Referring now to FIG. 2 in which there is shown a continuous flow oven 200 in which a hot gas blower or ventilator 211 is disposed in a central section of the heating chamber 222. In this embodiment of the invention, the burners 204 direct their flames 205 onto the material 203. It is to be noted that one burner is located proximate the entry opening 203 while another burner is located proximate the exit opening 221.

The primary convection currents, which comprise exit gases 206, travel towards the center of the oven and are pulled into the intake 230 of the blower or ventilator 211. A portion of gases 206 pass through the exit flues 214, which are disposed on either side of the blower 211, and thus exit from the heating chamber. The gases sucked up by blower 211 are ejected into the compression chambers 209 via exhaust openings 231 located on both sides of the blower 211. These gases, under pressure, are directed downwardly through jets 210*a* that are angled at a direction towards the center of the oven chamber and provide an auxiliary or secondary exit gas stream 212 which reacts with the primary gas stream 206 in the same manner as was described with reference to FIG. 1.

The baffles 219 located in the pressure chamber 209 proximate the exit openings 231 of blower 211 functions to diffuse the gases in the proximate area of burner 204 in order to lower or moderate the very high temperature occurring in that location.

It has been found the provision of two burners 204 and a greater number of jet openings 210*a* than are present in the embodiment shown in FIG. 1 is a simpler construction, which yields the same results.

The sensing devices 213*a* and 213*b* function in the same manner as devices 13*a* and 13*b* and prevent overheating of the blower 211 and the material 203 to be heated.

The embodiment of the present invention illustrated in FIGS. 3 and 4 operate under the same principles as set forth hereinabove, and provide for the heating of flat ingots on both sides. Here two ingots 301 are placed in the oven chamber 322 that has a secondary or auxiliary heating portion 324 which includes an auxiliary blower 315, an auxiliary pressure chamber 309*a*, and an exhaust port or flue 318.

Figure 3:
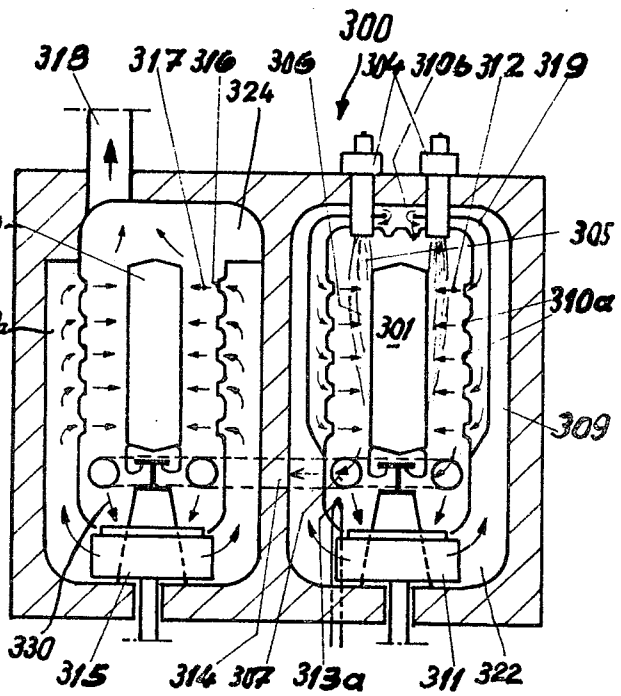
FIG. 3 is a cross-sectional view of the third embodiment of the present invention showing the heating of both sides of ingots disposed therein.
Figure 4:
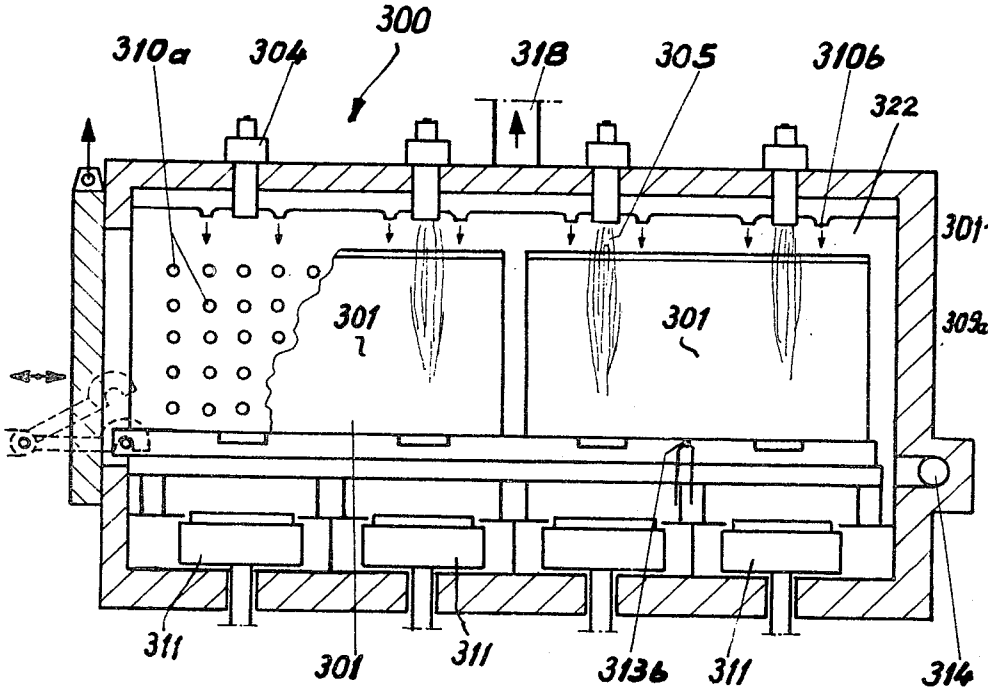
FIG. 4 is a longitudinal cross-sectional view of the oven shown in FIG. 3.

Referring now to FIGS. 3 and 4, it may be seen that oven 300 is provided with two rows of burners 304 and their exiting flames 305 and thus, their primary exiting gases 306 run parallel to the surfaces to be heated. A plurality of hot gas blowers 311 are located on the opposite end from the burners 304. The blowers 311 draw in or suck the exit gases 306 into intake opening 330 and discharge them out the exhaust opening 331 into the pressurized area 309 with the exit gases 312 directed through the jets 310*a* onto both surfaces of the bars to be heated. A portion of the secondary exit gases 312 exiting from the pressure chamber 309 through jets 310*b* are directed against flame 305 or burner 304. In this way the temperature of the flame is reduced and a more even temperature distribution is achieved.

Temperature control sensor unit 313*a* is located proximate the blower 311 and temperature control sensor unit 313*b* is located proximate the material to be heated. Both temperature units control the output of the burners 304 thus preventing any overheating. The remaining exit gases 307 (tertiary) which pass through aperture 314 provided in the oven chamber 312 give up a very substantial part of their heat content to the material 301 to be heated. In order to further utilize the remaining heat content of these tertiary exit gases they are led through exhaust aperture 314 into a further portion of the oven 324 which functions in the same manner as oven space 322 with the exception of burners 304 which are not included in this portion of the oven chamber. In the pre-heating chamber portion 324 blowers 315 are provided as described earlier, which suck in the flue gases from flue 314 via opening 330 and exit them through aperture 33, thereafter through jets 316 as a tertiary gas stream 317 against the material (ingot 301) to be heated. The gases are then finally permitted to exit through the exhaust or flue aperture 318.

FIG. 4 is a longitudinal cross-sectional view taken centrally along a vertical line running between the burners 304 in FIG. 3.

Figure 5:
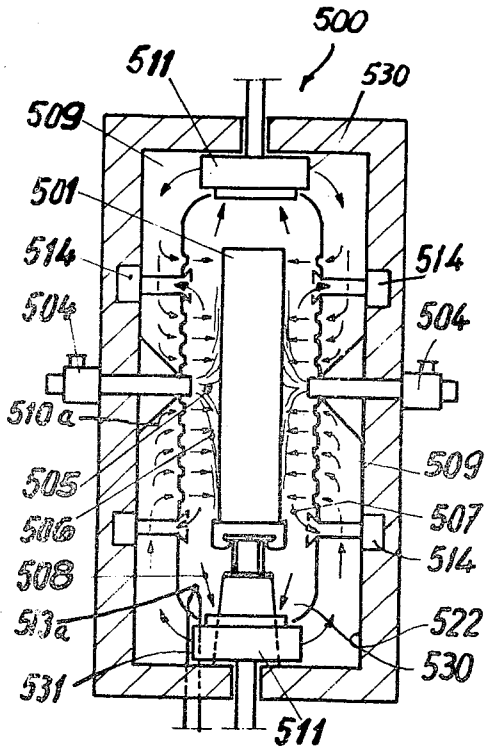
FIG. 5 is a longitudinal cross-sectional view of a fourth embodiment of the present invention showing the heating of both sides of the ingots disposed therein.

Referring now to FIG. 5 which shows still another embodiment of the oven 500 of the present invention. The oven 500 is designed to provide heating on both sides of the ingot 501 with burners 504 centrally disposed on both sides of the oven and disposed perpendicular to the surface of the ingot to be heated. Hot gas blowers or ventilators 511 are provided in opposite ends of the heating chamber 522. The secondary exit gases 507 are again removed through flues 514. It is to be noted that in this embodiment of the present invention the burners 504 direct the flame directly onto the object to be heated. Intake aperture 530 of the blowers 511 sucks the exhaust gases 506 and transfers them out of the exhaust aperture 531 into pressure chamber 509 where they are directed to exit, via jets 510*a*, and mix with the primary exhaust gases 506 dispersing these gases and intermixing therewith to more evenly heat the surface of the ingots 501. Thus, here again, the function of this embodiment is the same as set forth earlier for the other embodiments of the present invention.

Figure 6:
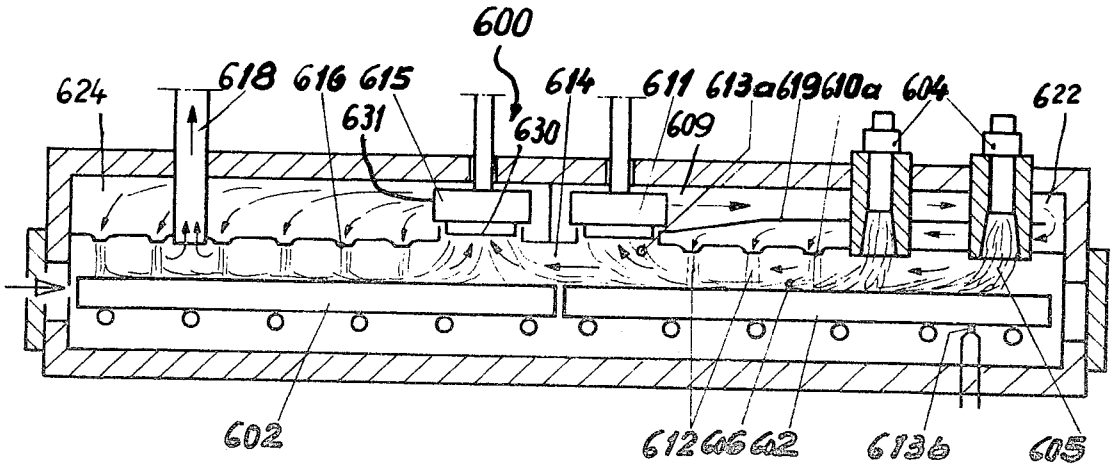
FIG. 6 is a longitudinal cross-sectional view of a fifth embodiment of the oven of the present invention used for heating a cylindrical ingot.

The embodiment shown in FIG. 6 is utilized to heat one side of the ingots 602 in the oven chamber 622 while providing for a pre-heating in the auxiliary portion of the oven or pre-heating chamber 624. In this embodiment of the present invention the primary exhaust gases 606 from the flame 605 of burner 604 are partially taken up or sucked into and compressed by means of blowers 611 and 615 and fed through to chamber 609. The exhaust gases are then directed in a downwardly direction through jets 610*a* onto the material 602 and thus, recirculated. Remaining portions of the exhaust gases pass through flue 614 which communicates with pre-heating chamber 624. The gases entering chamber 624 are sucked in through the air intake opening 630 of blower 615 and exhausted into compression chamber 624 via exhaust opening 631 thereof. The gases are then directed via jets 616 of pre-heating chamber 624 to the material 602 which is to be pre-warmed. Thermal sensors 613*a* and 613*b* function as described earlier.

Figure 7:
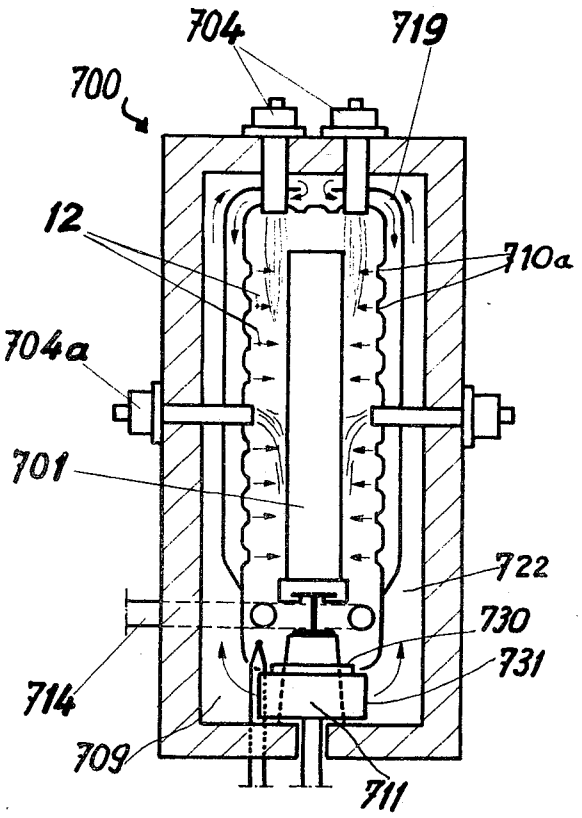
FIG. 7 is a cross-sectional view of a sixth embodiment of the present invention showing the heating on both sides of an ingot disposed therein.
Figure 8:
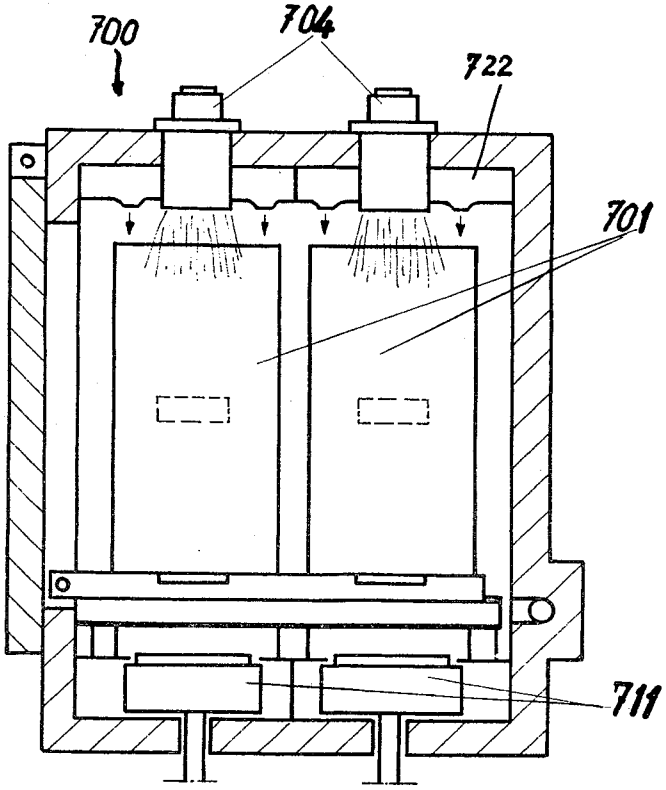
FIG. 8 is a longitudinal cross-sectional view of the oven shown in FIG. 7.

The embodiment of the oven 700 disclosed in FIGS. 7 and 8 is directed to an oven which provides heating on both sides of flat ingots 701, in accordance with the principles of the present invention. In this embodiment the burners 704 are located at the head portion of the heating chamber 722 opposite the hot gas blower or ventilator 711 located at the tail portion of the chamber relative to ingot 701, which is the material to be heated. In addition, between the burners 704 and the blowers 711 on both sides of the heating chamber 722 are located suplemental burners 704*a*. These burners serve to mix and reheat the primary exit gases 706 from the burners 704 and those secondary gases 712 which have passed through the blowers 711, via the input intake opening 730, and exiting through the exhaust opening 731 into the pressure chamber 709. The jets 710*a* direct exhaust gases onto the ingot 701 which is to be heated.

It will be seen from the foregoing embodiments that the principles set forth herein for the heating of materials which may be light metal or light metal alloys can be achieved in several modifications of the present invention; each, however, utilizes the principles as set forth herein; each embodiment depends upon the impingement of recycled exhaust gases upon the object or materials to be heated while the material is being directly heated by the primary exhaust gases flowing along it. This general procedure leads to optimal use of thermal content of exit gases, increases the speed of heating under lower energy consumption, and reduces the thermal contamination of the environment.

It will be understood that various changes in the details, materials, arrangment of parts, and operating conditions which have been herein described and illustrated in order to explain the nature of the invention may be made by those skilled in the art within the principles and scope of the present invention.

Having thus set forth the nature of the invention, what is claimed is:

1. A continuous flow oven for heating materials comprising:

a. a heating chamber having a heating means disposed therein, an input opening, an exit opening and an exhaust port, said input opening being adapted to receive said materials which exit via said exit opening;

b. means for directly heating said material with the convection air currents from said heating means directed thereon;

c. blower means having intake and exhaust openings within said heating chamber, said blower intake sucking said convection air currents from said chamber and exhausting them under pressure; and d. a pressure chamber cooperating with said blower exhaust opening and receiving said pressurized air currents, said pressure chamber being provided with a plurality of exhaust jets directed towards said material to be heated, said pressurized air currents mixing and interspersing with said convection air currents as it impinges upon said material.

2. An oven according to claim 1 wherein said heating means is disposed at one end of said heating chamber and said chamber exhaust port and said blower means are disposed at the opposite end thereof with said pressure chamber and associated exhaust jets being disposed therebetween.

3. A continuous flow oven for heating materials comprising:

a. a heating chamber having heating means disposed therein, an input opening, an exit opening and an exhaust port, said input opening being adapted to receive said materials which exit via said exit opening;

b. means for directly heating said material with the convection air currents from said heating means directed thereon, said heating means being disposed at one end ofsaid heating chamber and said chamber exhaust port being disposed at the opposite end thereof, said convection air currents being the exhaust gases generated by said heating means;

c. blower means having intake and exhaust openings disposed proximate said chamber exhaust port and within said heating chamber, said blower intake sucking said convection air currents from said chamber and exhausting them under pressure; and d. a pressure chamber cooperating with said blower exhaust opening and receiving said pressurized air currents, said pressure chamber being provided with a plurality of exhaust jets directed towards said material to be heated, said pressurized air currents mixing and interspursing with said air currents, said pressure chamber and associated exhaust jets being disposed between said heating means and said chamber exhaust port and said blower means.

4. An oven according to claims 1 or 3 wherein said heating means generates a flame directed substantially perpendicular to said material to be heated.

5. An oven according to claims 1 or 3 further including means for continuously moving said material through said heating chamber from said input opening and out said exit opening.

6. A flow oven for heating materials according to claims 1 or 3 wherein said input opening and said exhaust port are one and the same.

7. The method of heating continuously moving material in a chamber having a heating means disposed therein; in put and output openings; and an exhaust port; comprising;

a. feeding said material into said input opening of said heating chamber;

b. heating said material with the convection air currents from said heating means directed thereon;

c. compressing a major portion of said convection air currents appearing proximate said exhaust port; and d. directing said compressed air currents by means of jets towards said material to be heated tomix and intersperse with said convection air currents as it impinges upon said material.

8. The method of claim 7 further including moving said material through said heating chamber in a predetermined time.

* * * * *